US006628251B1

(12) United States Patent
Ishizuka

(10) Patent No.: US 6,628,251 B1
(45) Date of Patent: Sep. 30, 2003

(54) METHOD CAPABLE OF ESTABLISHING A HIGH CONTRAST ON A PDP

(75) Inventor: Mitsuhiro Ishizuka, Tokyo (JP)

(73) Assignee: NEC Corporation, Tokyo (JP)

( * ) Notice: Subject to any disclaimer, the term of this patent is extended or adjusted under 35 U.S.C. 154(b) by 247 days.

(21) Appl. No.: 09/593,159

(22) Filed: Jun. 14, 2000

(30) Foreign Application Priority Data

Jun. 15, 1999 (JP) ..... 11-168222

(51) Int. Cl.[7] ..... G09G 3/28
(52) U.S. Cl. ..... 345/60; 345/63; 345/66
(58) Field of Search ..... 345/60, 62, 63, 345/66, 67, 68, 71, 72; 313/582, 583, 584, 585, 586, 587; 315/169.1–169.4

(56) References Cited

U.S. PATENT DOCUMENTS 5,854,540 A * 12/1998 Matsumoto et al. ..... 315/169.1
6,124,849 A * 9/2000 Ito et al. ..... 345/204
6,144,348 A * 11/2000 Kanazawa et al. ..... 345/60
6,313,580 B1 * 11/2001 Makino ..... 313/582

FOREIGN PATENT DOCUMENTS

| | | |
|---|---|---|
| JP | 3-219286 | 9/1991 |
| JP | 4-280289 | 10/1992 |
| JP | 8-221036 | 8/1996 |
| JP | 10-222123 | 8/1998 |

* cited by examiner

*Primary Examiner*—Dennis-Doon Chow
(74) *Attorney, Agent, or Firm*—Sughrue Mion, PLLC

(57) ABSTRACT

In a method of driving a plasma display panel (PDP) to display an image at every field that is divisible into from first to last sub-fields, priming discharges are caused to occur only within a scanning period of the first sub-field by supplying scan priming pulses and priming data pulses to scanning and data electrodes, respectively. The scanning and the data electrodes driven in the scanning period are made to correspond to cells to be displayed in the following sub-fields. The scan priming pulses may have a width wider that that used in the remaining sub-fields or may partially overlap with one another.

32 Claims, 18 Drawing Sheets

METHOD CAPABLE OF ESTABLISHING A HIGH CONTRAST ON A PDP

BACKGROUND OF THE INVENTION

This invention relates to a driving method for use in driving a plasma display panel (PDP).

In general, a PDP of the type described has various advantages such that a thin structure, a high contrast ratio, and a high speed response can be achieved and a large size screen can be realized without flickering. In addition, multi-color displays can also be accomplished by the PDP with a luminescent material of a self-emission type. Therefore, it is a recent trend that the PDP has been widely used in various fields related to computers and the like.

Conventionally, a PDP of the type described is classified by driving methods into an A. C. type and a D. C. type. Herein, the A. C. type PDP has electrodes covered with a dielectric film and a protection film and is indirectly operated in the state of an A. C. discharge while the D. C. type PDP has electrodes exposed to discharge spaces and is operated in the state of a D. C. discharge.

Moreover, the A. C. type PDP is further divided into a double-electrode opposing type having two opposed electrodes, a surface-discharge type having two electrodes on the same surface, and a triple-electrode type developed from both types. Recent attention has been mainly focused on the triple-electrode type PDP.

Such a D. C. type or an A. C. type PDP tends to adopt a driving method which uses a memory effect of each discharge cell and which may be called a memory drive method. With this method, it is known in the art that a high average luminance can be accomplished by the memory drive method because light emission lasts even for a non-scanning period.

Herein, a conventional driving method will be described in connection with the A. C. type PDP which has three electrodes. As known in the art, such a PDP has a plurality of scanning electrodes arranged in parallel with one another in one direction, a plurality of sustain electrodes adjacent to and parallel with the scanning electrodes, and a plurality of data electrodes perpendicular to the scanning electrodes on a surface different from the scanning and the sustain electrodes. With this structure, cells are defined at cross points between the scanning electrodes and the data electrodes. Thus, the cells are arranged in rows and columns on a surface of the PDP.

In the conventional driving method, the cells are scanned by successively selecting the scanning electrodes and are put into lightened states by selecting the data electrodes so as to cause discharges to occur between the selected scanning electrodes and the selected data electrodes. As a result, an image is displayed on the PDP at every field.

As one of the conventional driving methods, so-called a sub-field driving method is known which divides each field into first through n-th sub-fields, where n is a positive integer greater than unity. With this method, all of the cells are scanned in every sub-field and are discharged each time when the corresponding data electrodes are selected. Under the circumstances, the cells are repeatedly discharged within each field and exhibit a luminance or brightness in dependency upon repetition times of the discharges of each cell within the respective sub-fields.

Heretofore, a technique of priming or provisional discharges is used in the PDP before usual discharges, namely, normal discharges are started so as to realize a high speed operation. According to this technique, the priming discharges are caused to occur in all the cells at every sub-field of the field.

Although such priming discharges facilitate the following normal discharges in the next sub-field, non-lightened cells are also undesirably influenced by the priming discharges. This is because the priming discharges are carried out regardless of whether or not the cells are lightened. Therefore, a contrast ratio is seriously degraded in a dark region of an image displayed on the PDP.

In Japanese Unexamined Publication No. Hei 4-280289, namely, 280280/1992 (will be referred to as Reference 1), a screen is divided into a plurality of regions in each of which the priming discharges are individually discharged. However, no consideration is made at all in Reference 1 about a reduction of the contrast ratio in the dark region.

In Japanese Unexamined Publication No. Hei 8-221036 (221036/1996) (will be referred to as Reference 2), disclosure is made about avoiding a reduction of the contrast ratio. In Reference 2, proposals have been offered in connection with a method of counting display data numbers in each sub-field and generating priming discharges in cells which have a lot of data numbers and a method of generating priming discharges with reference to a previous sub-field. With these methods, the priming discharges are often caused to occur in non-lightened cells which have the data number 0. When such non-lightened cells are undesirably influenced by the priming discharges, the luminance in such cells never become equal to zero. In addition, no teaching is made in Reference 2 about avoiding diffusion of charged particles to non-lightened cells.

SUMMARY OF THE INVENTION

It is an object of this invention to provide a method of driving a PDP without a reduction of a contrast ratio in a dark region.

It is another object of this invention to provide a method of the type described, which can use a wide range of an operation voltage.

It is still another object of this invention to provide a method of the type described, which can improve a write-in characteristic.

According to an aspect of this invention, a method is for use in driving a plasma display panel (PDP) to display an image at every field which is divisible into first through n-th sub-fields, where n is a positive integer greater than unity. The PDP comprises a plurality of scanning electrodes, a plurality of data electrodes, and a plurality of cells located at cross points between the scanning electrodes and the data electrodes. The method comprises the steps of determining the first sub-field and the second through the n-th sub-fields as a priming sub-field and display sub-fields, respectively, causing priming discharges to occur at selected ones of the cells within the first sub-field, and causing display discharges to occur at the selected cells within the second through the n-th sub-fields to display the image.

According to another aspect of this invention, a method is for use in driving a plasma display panel (PDP) to display an image at every field which is divisible into first through n-th sub-fields, where n is a positive integer greater than unity. The PDP comprises a plurality of first electrodes, a plurality of second electrodes intersecting the first electrodes, a plurality of third electrodes parallel with the first electrodes, and a plurality of cells located at cross points between the first electrodes and the second electrodes. The method comprises the steps of determining the first sub-field and the second through the n-th sub-fields as a priming sub-field and display sub-fields, respectively, supplying the third electrodes with sub-priming pulses in the first sub-field. supplying the first and the second electrodes with first and second priming pulses, respectively, with the sub-priming pulses in the first sub-field to cause priming discharges to occur at selected ones of the cells within the first sub-field, and causing display discharges to occur at the selected cells within the second through the n-th sub-fields to display the image.

According to another aspect of this invention, a method is for use in driving a plasma display panel (PDP) to display an image at every field which is divisible into first through n-th sub-fields, where n is a positive integer greater than unity. The PDP comprises a plurality of first electrodes, a plurality of second electrodes intersecting the first electrodes, a plurality of third electrodes parallel with the first electrodes, and a plurality of cells located at cross points between the first electrodes and the second electrodes. The method comprises the steps of determining the first sub-field and the second through the n-th sub-fields as a priming sub-field and display sub-fields, respectively, successively supplying the first electrodes with first priming pulses partially overlapping with one another in the first sub-field, successively supplying the second electrodes with second priming pulses synchronized with the first priming pulses in the first sub-field to cause priming discharges to occur in selected ones of the cells determined by the first and the second electrodes and peripheral ones of the cells adjacent to the selected cells, and causing display discharges to occur at the selected cells within the second through the n-th sub-fields to display the image.

DESCRIPTION OF THE PREFERRED EMBODIMENTS

Figure 1:
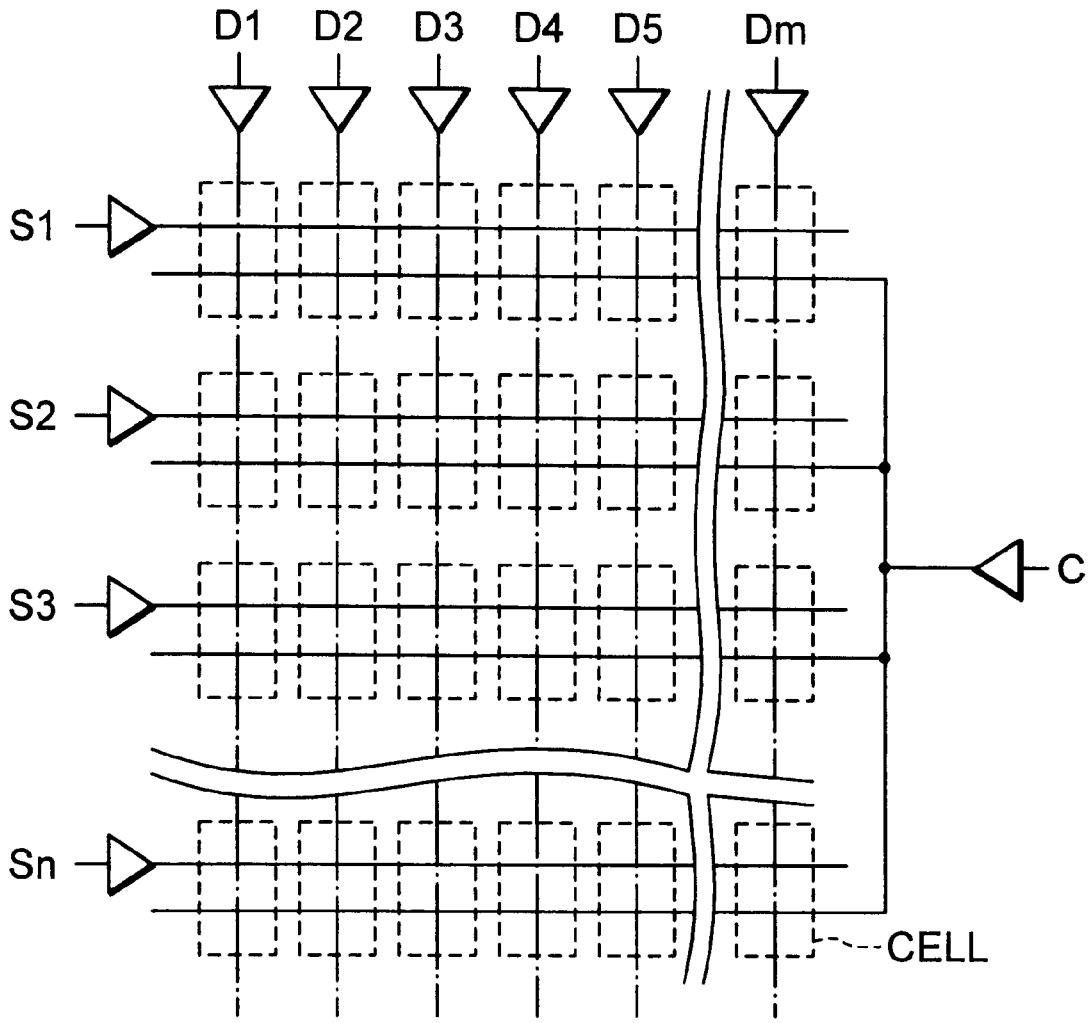
FIG. 1 PRIOR ART
FIG. 1 shows a diagrammatic view for use in describing a conventional PDP.

Referring to FIG. 1, a conventional plasma display panel (PDP) of an A. C. type will be at first described for a better understanding of this invention. The illustrated PDP has generally been called a triple-electrode surface-discharge type PDP and has a plurality of scanning electrodes S1 to Sn arranged in parallel with one another, sustain electrodes C parallel with the scanning electrode S1 to Sn, and a plurality of data electrodes D1 to Dm perpendicular to both the scanning electrodes S1 to Sn and the sustain electrodes C. For convenience of description, the scanning electrodes S1 to Sn, the data electrodes D1 to Dm, and the sustain electrodes C may be called first, second, and third electrodes, respectively. The PDP shown in FIG. 1 further has a plurality of cells located at cross points between the data electrodes D1 to Dm and the scanning and the sustain electrodes S1 to Sn and C. In other words, each cell is formed by one of the scanning electrodes, one of the sustain electrodes, and one of the data electrodes and emits light. From this fact, it is readily understood that the total number of the cells included in a single screen is specified by a product of each number, namely, n, of the scanning and the sustain electrodes and the number m of the data electrodes, namely, m and is therefore equal to n×m.

Figure 2:
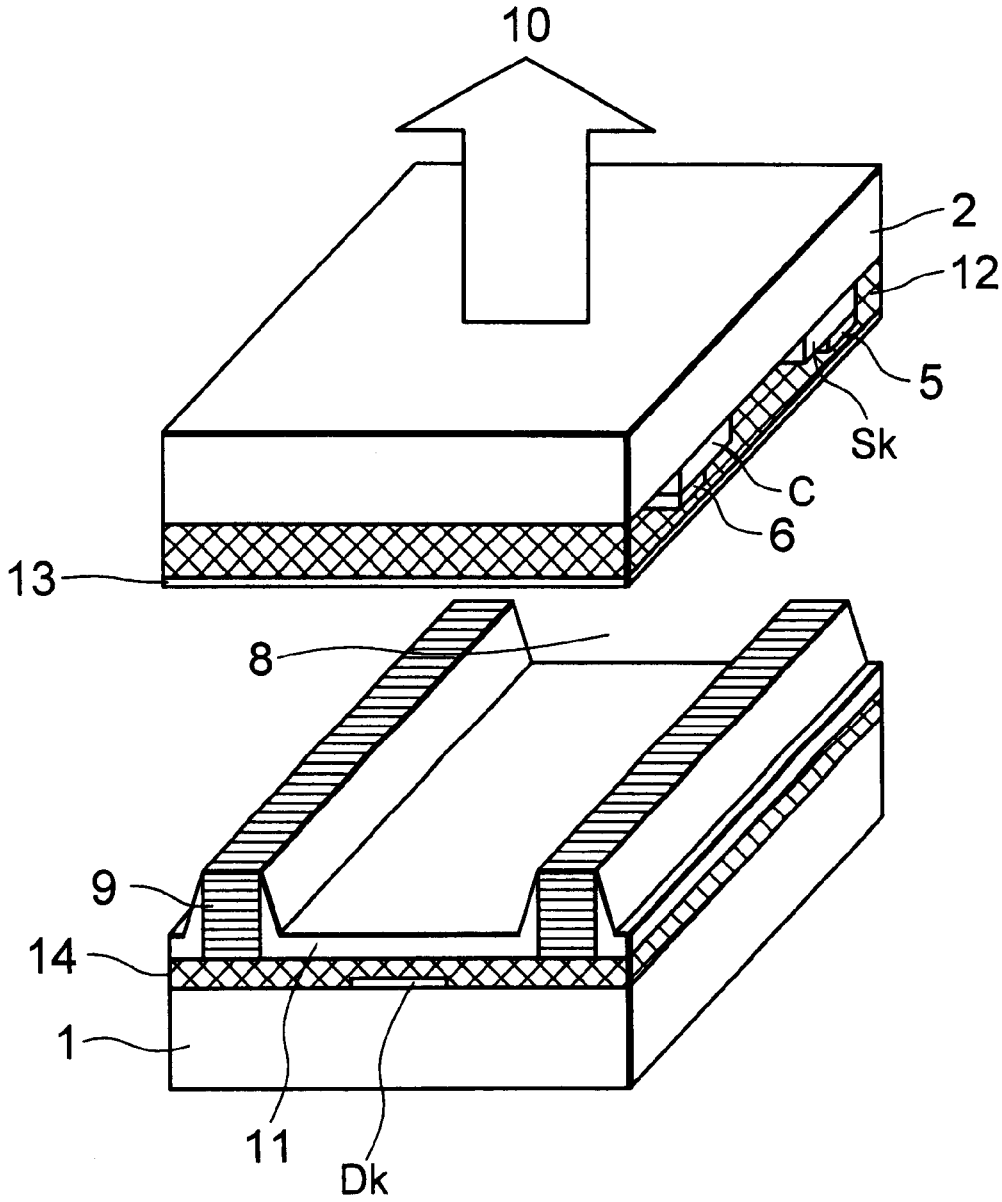
FIG. 2 PRIOR ART
FIG. 2 shows a perspective view for use in describing a structure of the PDP illustrated in FIG. 1.

Referring to FIG. 2, a single cell is illustrated which has a rear insulator substrate 1 and a front insulator substrate 2 each of which is usually made of glass. In the illustrated example, the scanning and the sustain electrodes Sk and C both of which are transparent are deposited on a back surface of the front substrate 2. On the scanning and the sustain electrodes Sk and C, trace electrodes 5 and 6 are covered so as to reduce electrical resistance. In addition, a dielectric film 12 and a protection film 13 of, for example, manganese oxide (MgO) are successively coated on the front substrate 2 and the trace electrodes 5 and 6. In this event, the protection film 13 is helpful to protect the dielectric film 12 from discharge.

On the insulator substrate 2, the data electrodes Dk are deposited which are perpendicular to the scanning and the sustain electrodes Sk and C. The data electrode Dk is covered with a dielectric film 14 and a plurality of partitions 9 are formed on the dielectric film 14 and arranged in parallel with one another to define cells.

The dielectric film 14 and side surfaces of the partitions 9 are covered with a phosphor layer 11.

As a result, the front and the rear insulator substrates 1 and 2 are opposed to each other with discharge gas spaces 8 which are left therebetween and which are filled with a discharge gas which may be, for example, helium gas, neon gas, xenon gas, or a mixed gas consisting of them. With this structure, the phosphor layer 11 serves to convert, into a visible ray or light, a ultraviolet ray emanating from discharge of the discharge gas.

Figure 3:
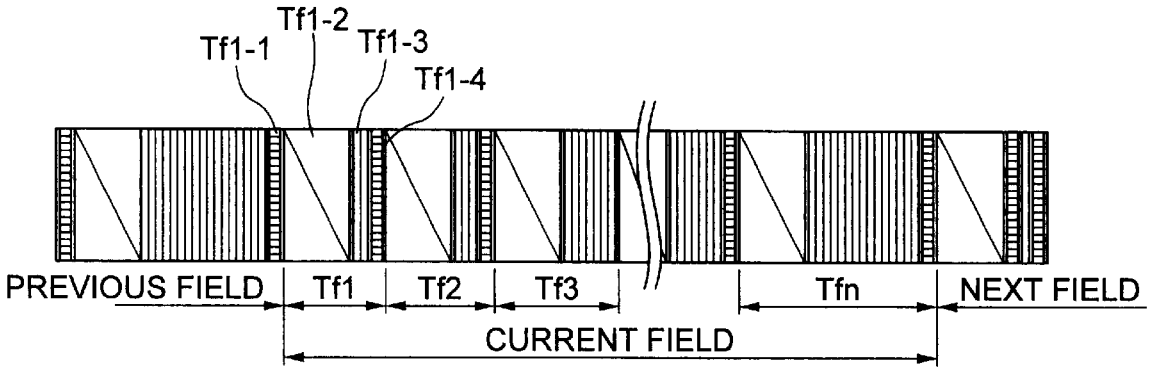
FIG. 3 PRIOR ART
FIG. 3 shows a time chart for use in describing a conventional driving method of driving the PDP illustrated in FIG. 1.

Referring to FIG. 3, description will be directed to a method of driving the PDP shown in FIG. 1. In the illustrated example, the driving method may use a sub-field driving technique which can realize a display of tones and which divides a single field into a plurality of sub-fields the number of which is concerned with a bit number of a pixel data signal. More specifically, the sub-fields are equal in number to n when the pixel data signal is composed of n bits, where n is an integer greater than unity.

In this event, the pixel data signal can display each pixel with tones of $2^n$. For example, when the pixel data signal is composed of eight bits, the sub-fields in each field are equal in number to eight.

Herein, it is to be noted that each cell arranged on a screen is scanned within each of the sub-fields, regardless of whether or not the cells are lightened brightly.

Turning back to FIG. 3, let the current field be divided into eight sub-fields SF0 to SF7 which last for the first through the eighth ones of the sub-fields, respectively.

As shown in FIG. 3, a current one of the fields that follows a previous field and that precedes a next following field is divided into first through eighth ones of sub-fields SF0 to SF7. The first through the eighth sub-fields last for first through eighth display time intervals depicted by Tf1 to Tf8, respectively. Moreover, it is to be noted that each of the sub-field SF0 to SF7 is also subdivided into a whole priming period Tf1-1, a scanning period Tf1-2, a discharge sustaining period Tf1-3, and an erasing or a reset period Tf1-4 for erasing a wall charge. Various driving pulses are produced for each period Tf1-1 to Tf1-4 in a manner to be described later in detail. For the sustaining periods of the first through the eighth sub-fields SF0 to SF7, sustaining discharges are executed one (1), twice (2), four (4), eight (8), sixteen (16), thirty-two (32), sixty-four (64), and 128 times, respectively.

Figure 4:
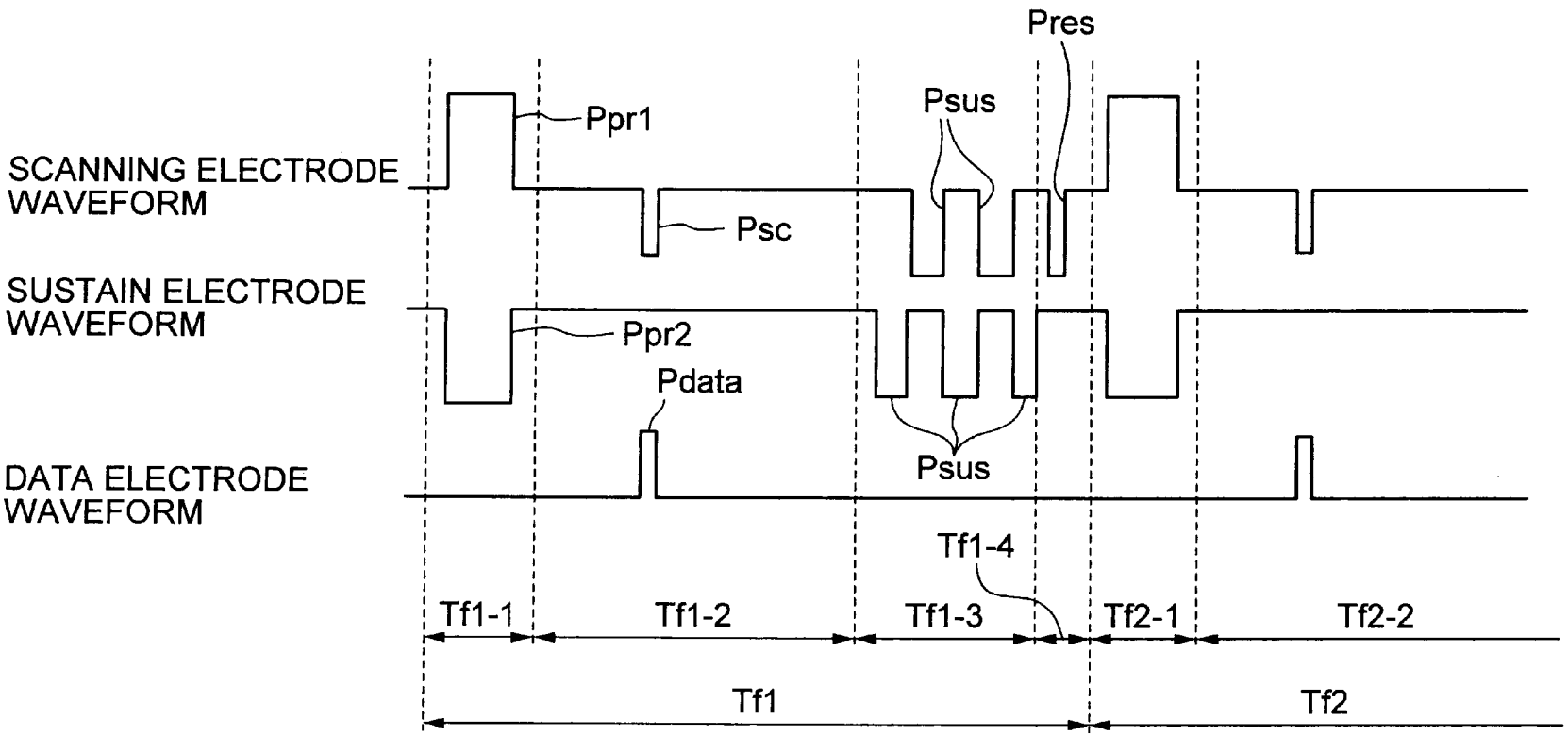
FIG. 4 PRIOR ART
FIG. 4 shows a time chart for use in describing operation in the conventional driving method more in detail.

Referring to FIG. 4 together with FIG. 3, a driving operation will be described in detail in connection with the first display time interval Tf1 which defines the first sub-field SF0 and which is divided into the whole priming period Tf1-1, the scanning period Tf1-2, the sustaining period Tf1-3, and the reset period Tf1-4, as mentioned before.

In FIG. 4, the priming or provisional discharge is caused to occur within the whole priming period Tf1-1 so as to stabilize a high speed driving operation. As shown in FIG. 4, all the scanning electrodes S1-Sn are supplied with a positive priming pulse Ppr1 within the whole priming period Tf1-1. Simultaneously, the sustaining electrodes C are supplied with a negative priming pulse Ppr2 within the whole priming period Tf1-1.

Such supply of the positive and the negative priming pulses Ppr1 and Ppr2 causes discharges to occur in all of the cells and brings about occurrence of charged particles. After the discharges are finished, wall charges are kept in each cell as wall charges and are erased by a self-erasing discharge which takes place due to the wall charges at the end of the pulses.

Thereafter, display data signals are written into the cells within the scanning period Tf1-2. Such a write-in operation of the display data is carried out by forming the wall charges. Specifically, the scanning electrodes S1 to Sn are successively given negative scanning pulses Psc during the scanning period Tf1-2. Positive data pulses Pdata are successively supplied in synchronism with the scanning pulses Psc to those of the data electrodes D1 to Dm which correspond to the display data signals, as shown along a third line of FIG. 4. Under the circumstances, the discharges are caused to occur at the cells which correspond to the data electrodes and the scanning electrodes simultaneously supplied with the data pulses Pdata and the scanning pulses Psc. As a result, such cells alone are lightened and the wall charges are formed in the cells. On the other hand, no wall charge is formed in the cells which are given either the scanning pulses Psc or the data pulses Pdata alone and which are not lightened or unlightened. This is because no discharge is caused to occur when both the scanning pulses to the data electrodes are given the scanning pulses Psc and the data pulses Pdata. Thus, the wall charges are selectively formed in the cells and serve to selectively provide lightened cells and unlightened cells.

The scanning period Tf1-2 is followed by the sustaining period Tf1-3 for maintaining lightened states of the lightened cells during the write-in operation. During the sustaining period Tf1-3, the sustaining electrodes C are given first negative sustain pulses Psus while each of the scanning electrodes S (suffix omitted) is given second negative sustain pulses Psus which are produced alternately with the first negative sustain pulses Psus, as shown in FIG. 4. Consequently, the lightened cells which keep the wall charges are repeatedly discharged and lightened. To the contrary, neither discharge nor lightening takes place in the unlightened cells which have no wall charges.

The sustaining period Tf1-3 is succeeded by a wall charge erasure or reset period Tf1-4 during which reset pulses Pres are delivered to all of the scanning electrodes. Thus, all of the cells are put into reset or erasure states.

Similar operation is carried out within each of the following sub-fields SF1 to SF7, namely, the second through the eighth display time interval Tf2 to Tf8. At any rate, the whole priming, the scanning, the sustaining, and the reset periods are successively repeated in each display time interval in the manner mentioned before and may be collectively called a display cycle to display an image on the screen.

However, the above-mentioned driving method is disadvantageous in that a contrast is deteriorated in a dark portion on the screen, as pointed out in the preamble of the instant specification.

Figure 5:
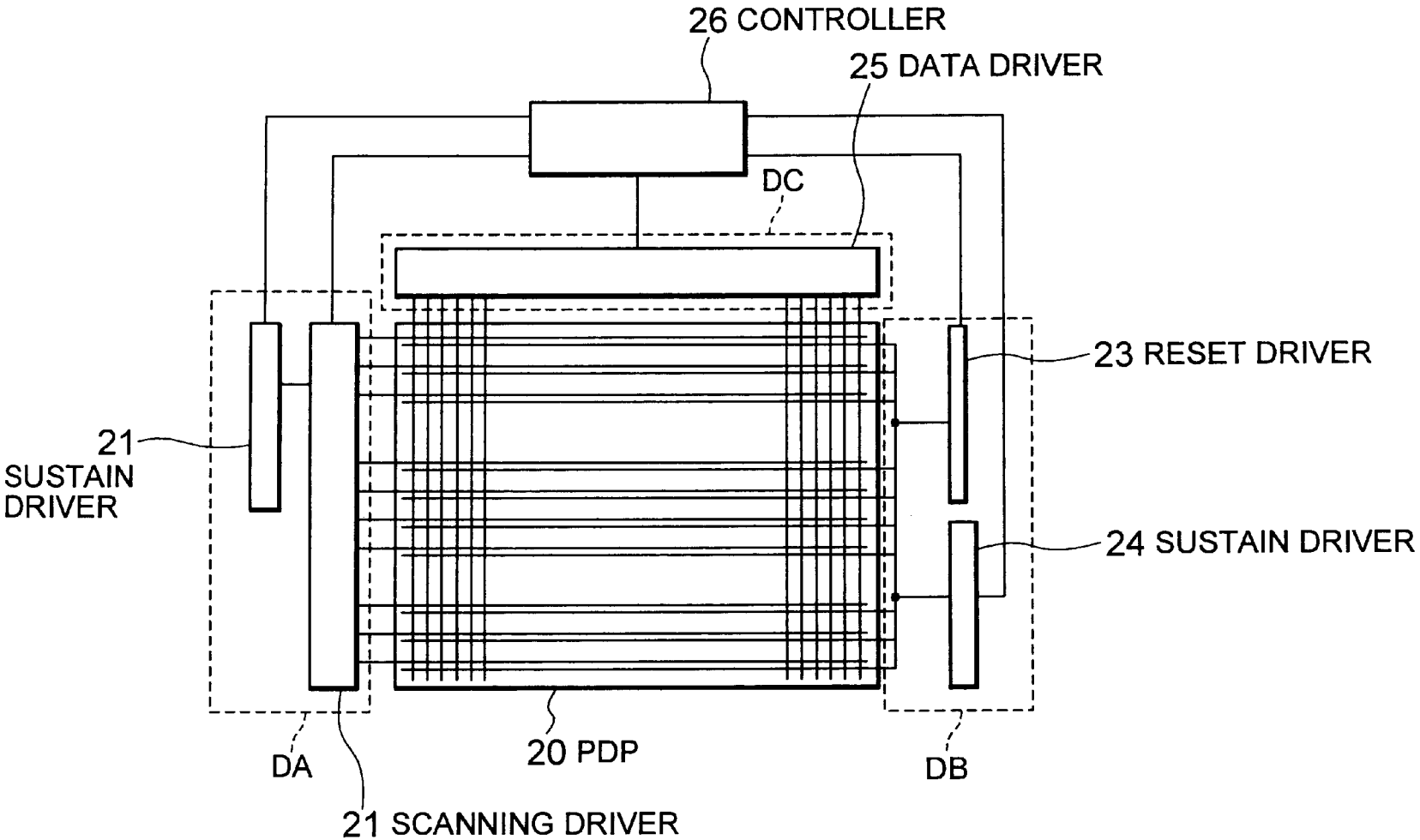
FIG. 5 shows a diagrammatic view of a PDP according to this invention.

Referring to FIG. 5, a plasma display panel (PDP) 20 of an A.C. type according to a first embodiment of this invention has a plurality of scanning electrodes Sk horizontally drawn in FIG. 5 and parallel with one another and a plurality of sustain electrodes C parallel with one another and with the scanning electrodes Sk. On both sides of the scanning and the sustain electrodes Sk and C, first and second side portions DA and DB are arranged to be coupled to the scanning and the sustain electrodes Sk and C.

More specifically, the first side portion DA has a scanning driver 21 which is connected to the scanning electrodes Sk and which supplies the scanning pulses to each of the scanning electrodes Sk one by one. In addition, the first side portion A further has a sustain driver 22 which is operable to supply all of the scanning electrodes Sk with scan priming pulses and sustain pulses.

On the other hand, the second side portion B has a reset or erasure driver 23 for supplying the reset pulses to all of the sustain electrodes C and a sustain driver 24 for supplying the sustain pulses to the sustain electrodes C.

The illustrated PDP 20 has a plurality of data electrodes Dk perpendicular to both the scanning and the sustain electrodes Sk and C. At the ends of the data electrodes Dk, a third side portion DC is placed which comprises a data driver 25 for producing the priming data pulses Ppd and the data pulses Pdata.

Each of the above-mentioned drivers 21 to 25 are connected to a controller 26 so as to switch them from one to another in response to image signals. Herein, it is noted that the controller 26 serves to determine each of the sub-fields and to select cells lightened in each field, as will become clear as the description proceeds. In other words, the illustrated controller 26 executes the step of determining the sub-fields in each field together with the lightened or unlightened cells in the illustrated example.

Figure 6:
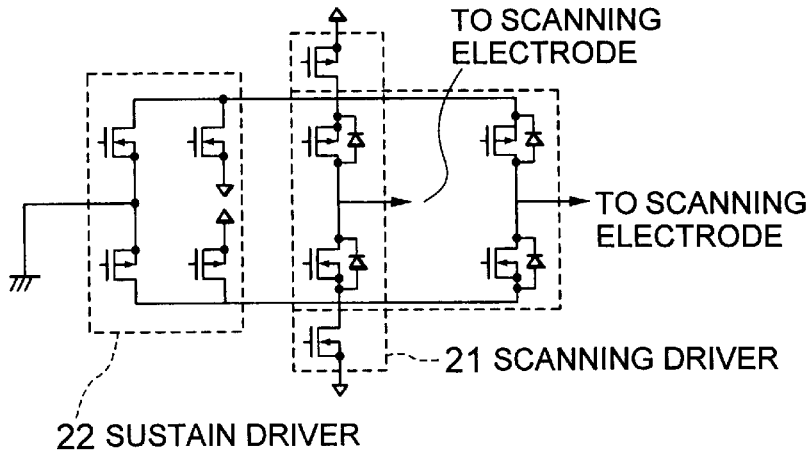
FIG. 6 shows a circuit diagram for use in the PDP illustrated in FIG. 5.
Figure 7:
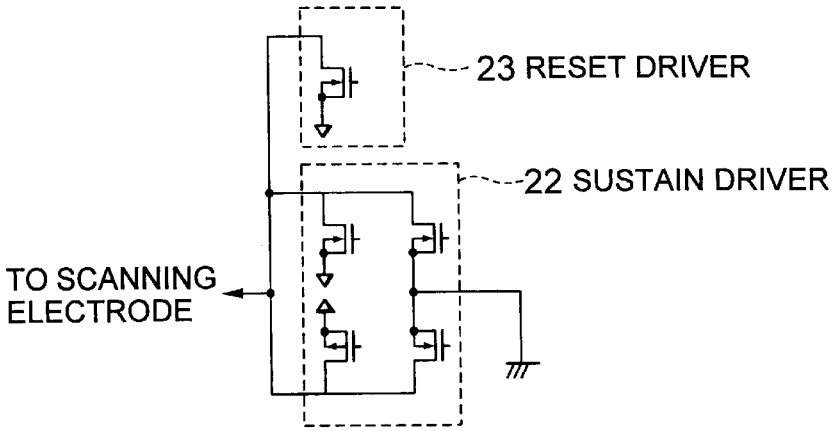
FIG. 7 shows another circuit diagram for use in the PDP illustrated in FIG. 5.
Figure 8:
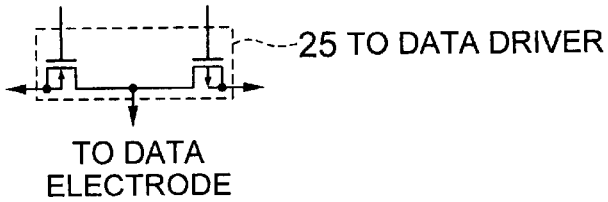
FIG. 8 shows an additional circuit diagram for use in the PDP illustrated in FIG. 5.

Referring to FIGS. 6, 7, and 8, the first, the second, and the third side portions DA, DB, and DC are illustrated, respectively. As shown in FIG. 6, the first side portion DA includes the sustain driver 22 formed by a plurality of transistors and the scanning driver 21 formed by a plurality of transistors connected to the scanning electrodes Sk. The second side portion DB includes the sustain driver 24 and the reset driver 23 connected to the sustain electrodes. The reset driver 23 is formed by a single transistor while the sustain drivers 24 is formed by a plurality of transistors. The reset and the sustain drivers 23 and 24 are connected in common to each other and are connected to the sustain electrodes C.

In addition, the third side portion DC includes the data driver 25 formed by two transistors connected in series and connected to the data electrodes of the PDP illustrated in FIG. 5.

Figure 9:
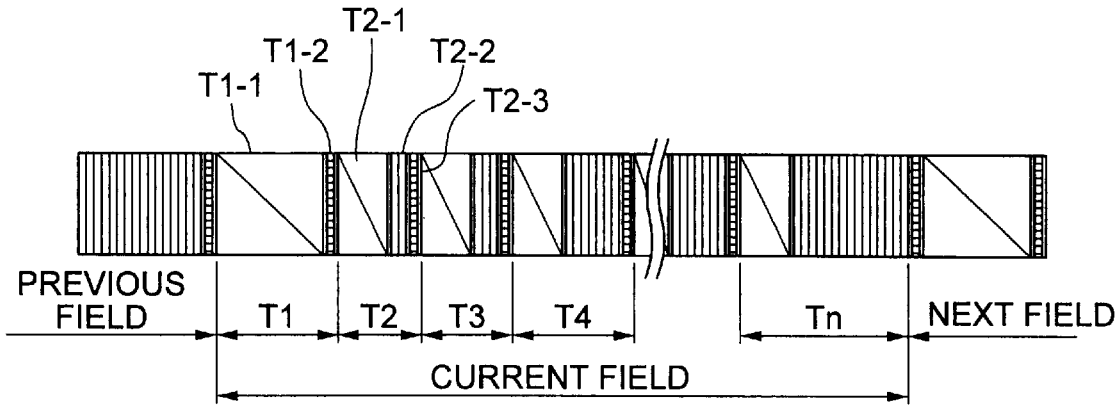
FIG. 9 shows a time chart for use in describing a driving method according to a first embodiment of this invention.

Referring to FIG. 9, description will be made about a driving method according to a first embodiment of this invention. In the illustrated example, the A.C. type PDP shown in FIGS. 5 to 8 is driven by the driving method. In FIG. 9, a single field alone is shown for brevity of description as a current field between a previous field and a next following field. The illustrated current field is divided into first through n-th time intervals T1 to Tn. Among the time intervals T1 to Tn, the first time interval T1 corresponds to the sub-field SF0 illustrated in FIG. 2 and is sub-divided into a scan priming period T1-1 and a reset period T1-2 for erasing or resetting wall charges. This shows that the first through the n-th time intervals T1 to Tn may be referred to as first through n-th sub-fields, respectively, like in FIG. 3.

Herein, it is to be noted in the illustrated example that priming discharges are caused to occur only in the first time interval or sub-field T1 illustrated in FIG. 9 and that no priming discharges are caused to occur in the second through the n-th time intervals (sub-fields). In other words, the first sub-field T1 is operable as a priming discharge sub-field while the second through the n-th sub-fields are operable as normal discharge sub-fields in which normal discharges are caused to occur.

In this connection, the first time interval T1 becomes long as compared with the first time interval Tf1 shown in FIG. 3. Specifically, scan priming pulses Psp are successively supplied to the scanning electrodes Sk (FIG. 5) in a predetermined order. In this event, each of the scan priming pulses has a pulse width that is wider than twice each of the conventional scan pulses.

When displays are made within each field on a selected image region of the PDP, the scan priming pulses Psp are delivered in the first time interval (first sub-field) T1 to the selected image region under control of the controller 26 and the scanning driver 21 illustrated in FIG. 5. The scan priming pulses Psp may be delivered to a peripheral region adjacent to the selected image region under control of the controller 26 illustrated in FIG. 5. In this case, the priming data pulses Pdp are delivered to the data electrodes Dk which are arranged on both the selected image region and the peripheral region. As a result, the priming discharges between the scanning electrodes Sk and the data electrodes Dk are caused to occur in the first time interval T1 only at the selected image region and the peripheral region.

The scan priming period T1-1 is succeeded by the reset period T1-2 which serves to reset the wall charges generated within the scan priming period T1-1.

In the second time interval T2, the image is displayed on the PDP. In other words, the second time interval T2 is operable to display tones of the image and may be made to correspond to the tone display sub-field SF1 shown in FIG. 3. The second time interval T2 is sub-divided into a scanning period T2-1, a sustain period T2-2, and a reset period T2-3. Within the scanning period T2-1, a tone of an image assigned to the second time interval T2 is written into desired cells of the PDP. During the sustain period T2-2, sustaining discharges are caused to occur in the cells written in the scanning period T2-1 preselected times allocated to the second time interval T2. In addition, wall charges which occur within the sustain period T2-2 are reset during the reset period T2-3.

Thereafter, discharges are repeated at every cell in each of the following time intervals T2 to Tn. In other words, each cell is discharged from the second time interval T2 to the n-th time interval Tn predetermined times corresponding to the tones of each cell. As a result, each cell exhibits or displays the tones corresponding to the discharge times in each of the second through the n-th time intervals T2 to Tn. Accordingly, the discharges which are caused to occur in the second through the n-th time intervals T2 to Tn may be collectively called display discharges which include the sustain discharges. At any rate, the image on each field is displayed on the PDP.

As mentioned before, each of the second through the n-th time intervals T2 to Tn is different from each of the second through the n-th time intervals Tf1 to Tfn illustrated in FIG. 3 in view of the fact that each of the former time intervals T2 to Tn has no whole priming period. This shows that the first time interval alone defines the whole priming period, namely, the priming sub-field in the PDP according to this invention while the second through the n-th time intervals define the tone display sub-fields.

Figure 10:
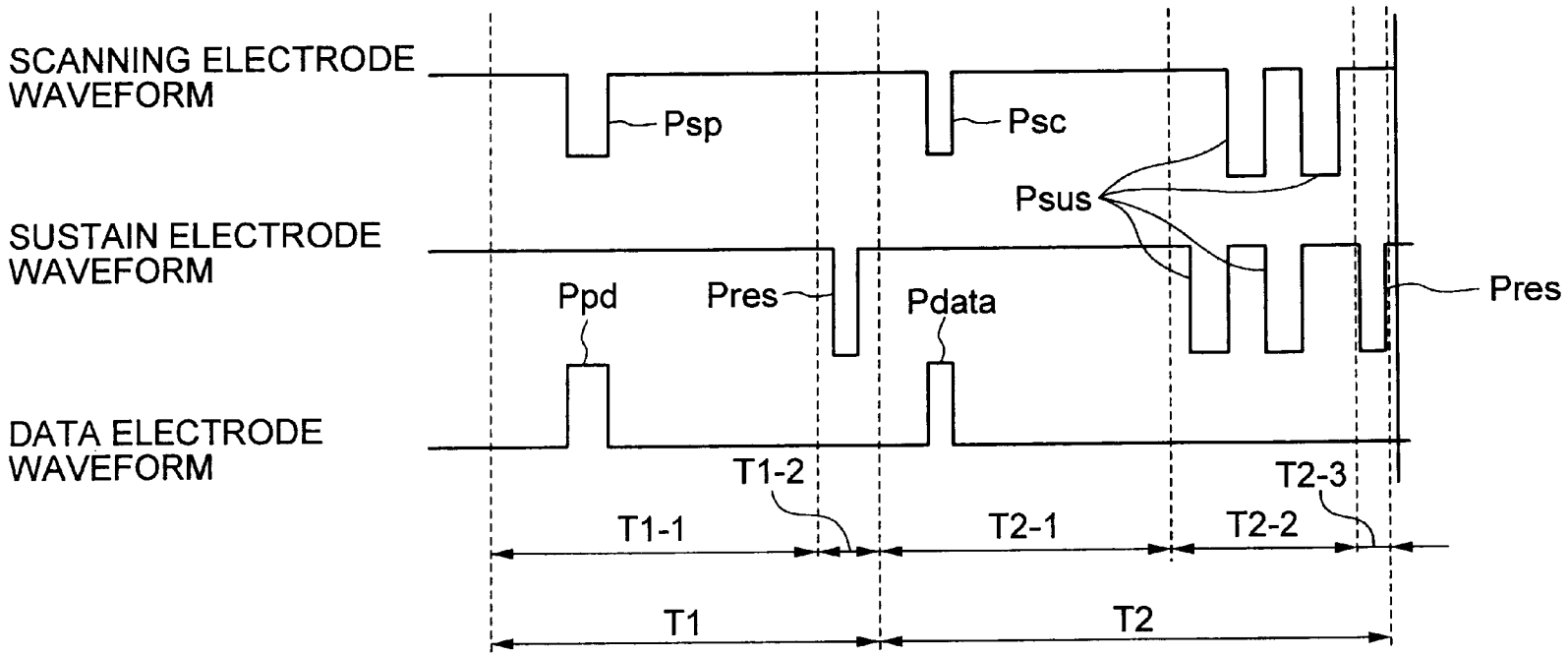
FIG. 10 shows a time chart for use in describing the driving method illustrated in FIG. 9 in detail.

Referring to FIG. 10, only the first time interval T1 and the second time interval T2 are shown so as to describe the driving method which is illustrated in FIG. 9 and which is for use in driving the A.C. type PDP (FIG. 5).

In FIG. 10, a negative scan priming pulse Psp is successively given to each of the scan electrodes Sk within the scanning period T1-1 of the first time interval T1, namely, the whole priming period. On the other hand, a positive priming data pulse Ppd is delivered within the scanning period T1-1 of the first time interval T1 to the data electrodes Dk selected in accordance with the image data to be displayed. Herein, it is to be noted that the positive priming data pulse Ppd must be distinguished from each positive data pulse Pdata that is generated within the scanning period T2-1 of the second time interval T2.

The positive data pulses Pdata are delivered to the data electrodes Dk which are selected in accordance with the image data within each scanning period T2-1, T3-1, . . . Tn-1 of the second through the n-th time intervals T2 to Tn.

With this structure, it is to be noted that the priming discharges are caused to occur between the scanning electrodes Sk and the data electrodes Dk that are supplied with the scan priming pulses Psp and the priming data pulses Ppd, respectively. Each negative reset pulse Pres is given to the scanning and the sustain electrodes Sk and C within each reset period T1-2 and T2-2 of the first and the second time intervals T1 and T2. Such a negative reset pulse Pres is helpful to erase or reset the wall charges which are adhered to the scanning and the sustain electrodes Sk and C during the scan priming period T1-1 or the sustain period T2-2, T3-2, . . . .

As readily understood from FIG. 10, no whole priming period is included in each of the second through the n-th time intervals T2 to Tn while the whole priming period is included only in the first time interval T1. This method is very effective to improve a contrast ratio of the image displayed on the PDP.

Figure 11:
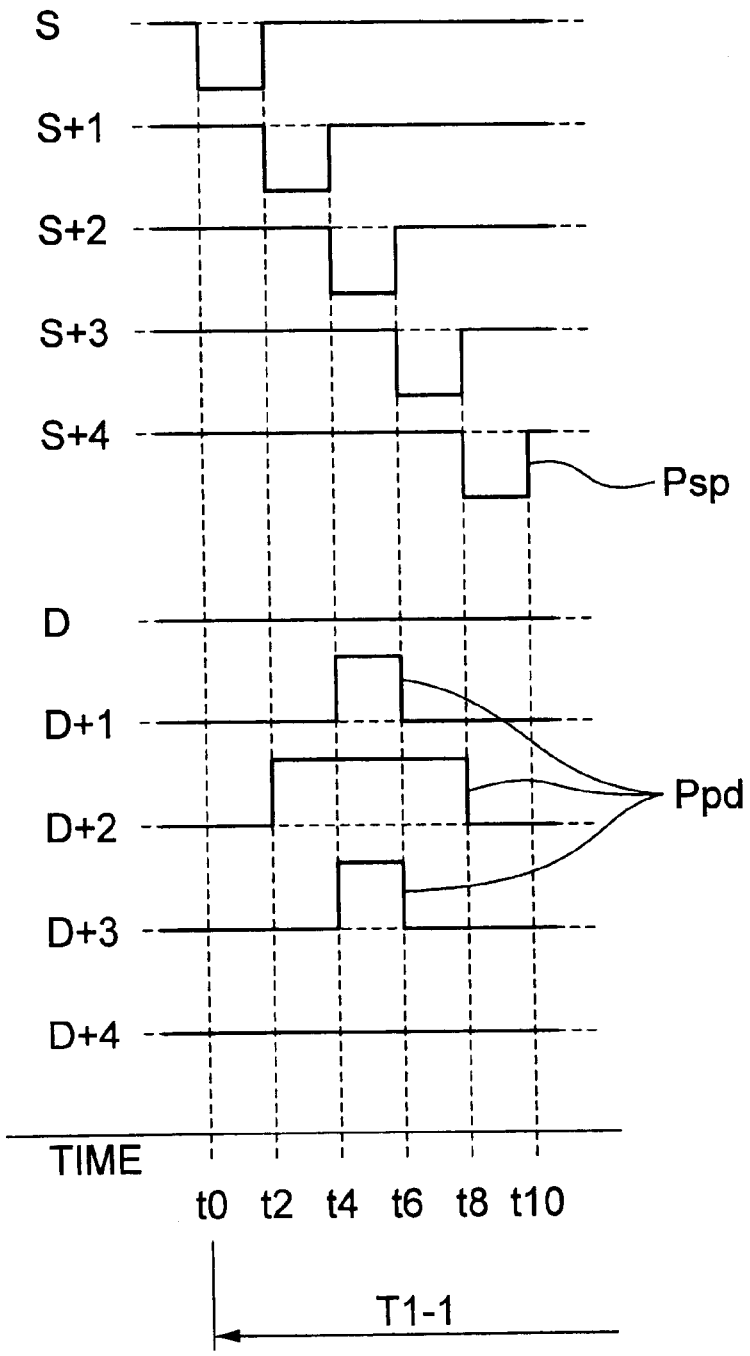
FIG. 11 shows a time chart for use in describing operation in a specific sub-field shown in FIG. 10.
Figure 12:
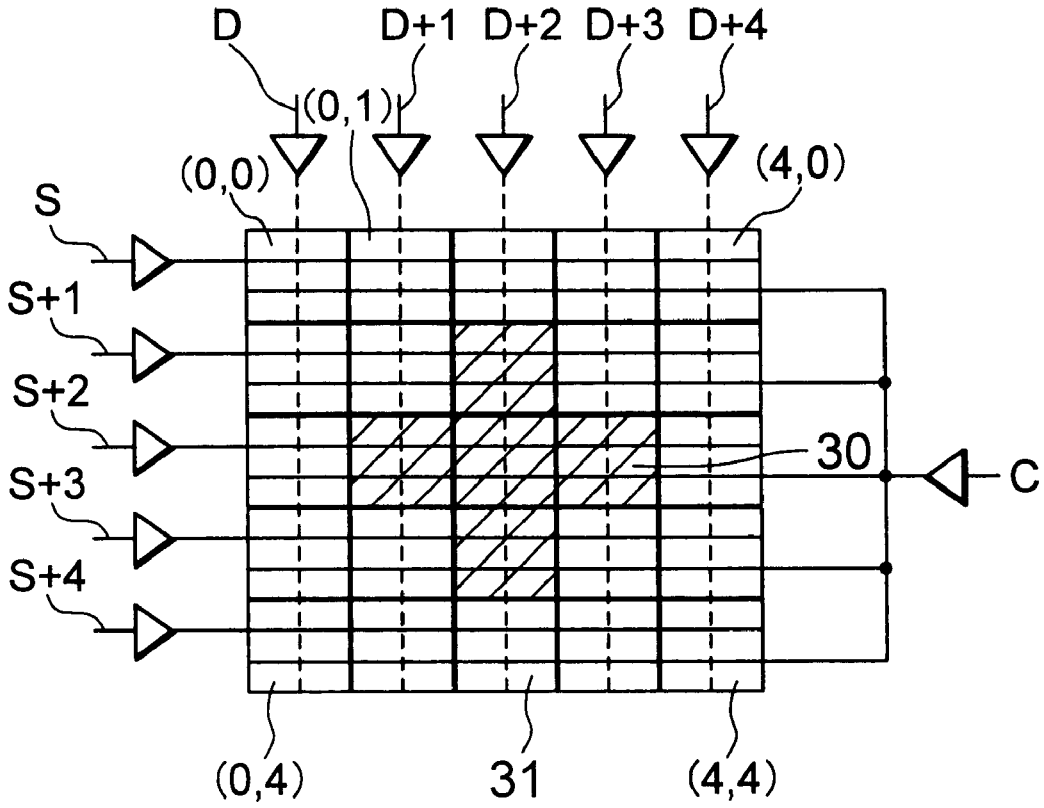
FIG. 12 shows a part of the PDP driven by the method illustrated in FIG. 11.

Referring to FIGS. 11 and 12, description will be made about operation which is carried out by the PDP in the scan priming period T1-1 of the first time interval T1. In FIGS. 11 and 12, it is assumed that the plasma display panel (PDP) is formed by twenty-five cells (5×5 cells) for brevity of description. The cells are specified by positions numbered from (0,0) to (4,4), as shown in FIG. 12. In this event, each cell is structured by a combination of one of the scanning lines S to S+4, one of the data electrodes D to D+4, and one of the sustain electrodes C. Under the circumstances, it is also assumed that five cells 30 (hatched in FIG. 12) alone are lightened with the remaining cells (depicted by 31) unlightened and are specified by (2,1), (1,2), (2,2), (3,2), and (2,3). In the illustrated example, priming discharges are caused to occur in all of the five cells hatched while no priming discharge are caused to occur in all of the non-hatched cells 31.

In order to lighten only the hatched cells shown in FIG. 12, the cells are driven in the manner illustrated in FIG. 11. More specifically, the scanning electrodes S to S+4 are successively driven by the negative scan priming pulses Psp, as shown in FIG. 12. It is noted that each of the scan pulses Psp has the pulse width 2 t, where t is representative of a pulse width of each of the scan pulses used in the tone display sub-fields, namely, the second through the n-th time intervals T2 to Tn. As a result, the scanning electrode depicted by S is driven by the scan priming pulse Psp which lasts for a time slot from t0 to t2. Likewise, the scanning electrodes S+1, S+2, S+3, and S+4 are driven by the scan priming pulses Psp for time slots from t2 to t4, from t4 to t6, from t6 to t8, and from t8 to t10. At any rate, the scan priming pulses Psp for the respective scanning electrodes S to S+4 are successively shifted from one another and have the pulse widths of 2 t.

On the other hand, the data electrode D+1 is given the positive priming data pulse Ppd which lasts for the time slot from t4 to t6 while the data electrode D+2 is supplied with the positive priming data pulse Ppd which lasts for the time slot from t2 to t8. In addition, the data electrode D+3 is given the positive priming data pulse Ppd which lasts for the time slot from t4 to t6. Each of the positive priming data pulse Ppd has a positive voltage between +50 volts and +80 volts.

Let a certain one of the cells be supplied with both the scan priming pulse Psp and the priming data pulse Ppd through the scanning and the data electrodes Sk and Dk. In this case, the discharge takes place in this cell because a potential difference between the electrodes exceeds a discharge start voltage in the cell. On the other hand, when cells are supplied with either the scan priming pulse Psp or the priming data pulse Ppd through the scanning electrode or the data electrode Dk, no discharge is caused to occur in the cells. From this fact, it is readily understood that the priming discharges are locally caused to occur at a restricted portion of the PDP in the illustrated example.

This shows that the priming discharges are previously caused to occur only at the cells which are to be enlightened and which are used for displaying an image and that the contrast ratio is improved because contrast becomes sharp between the displayed and lightened region and the remaining dark region.

Figure 13:
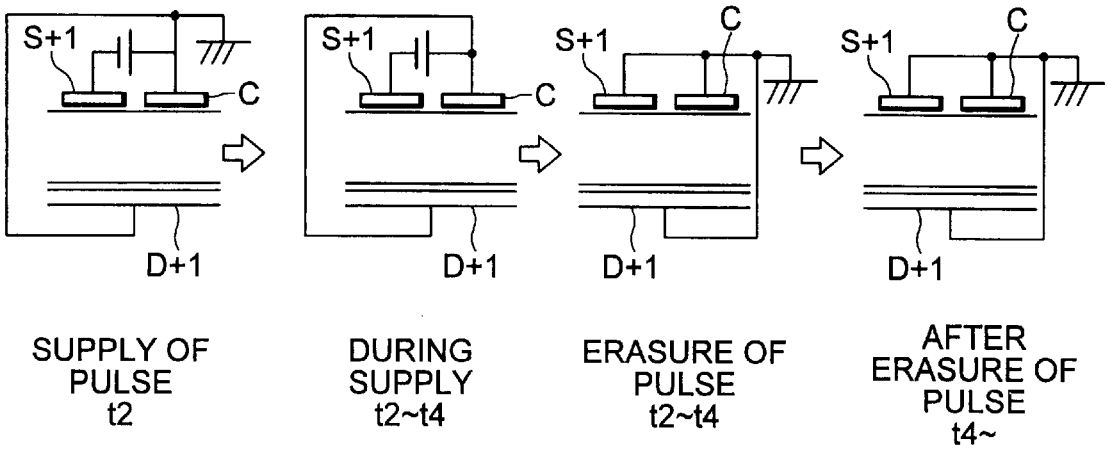
FIG. 13 shows transitional states of a single cell illustrated in FIG. 12.
Figure 14:
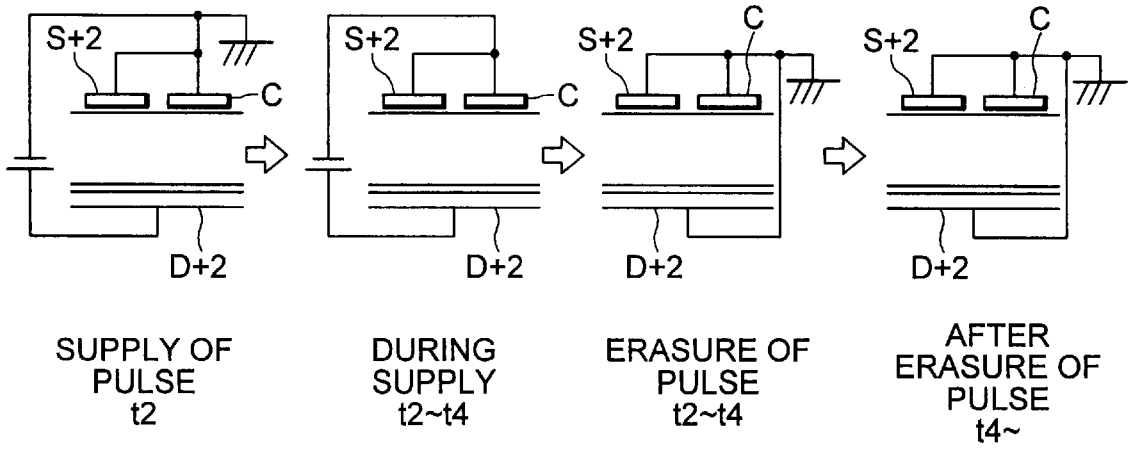
FIG. 14 shows transitional states of another cell illustrated in FIG. 12.
Figure 15:
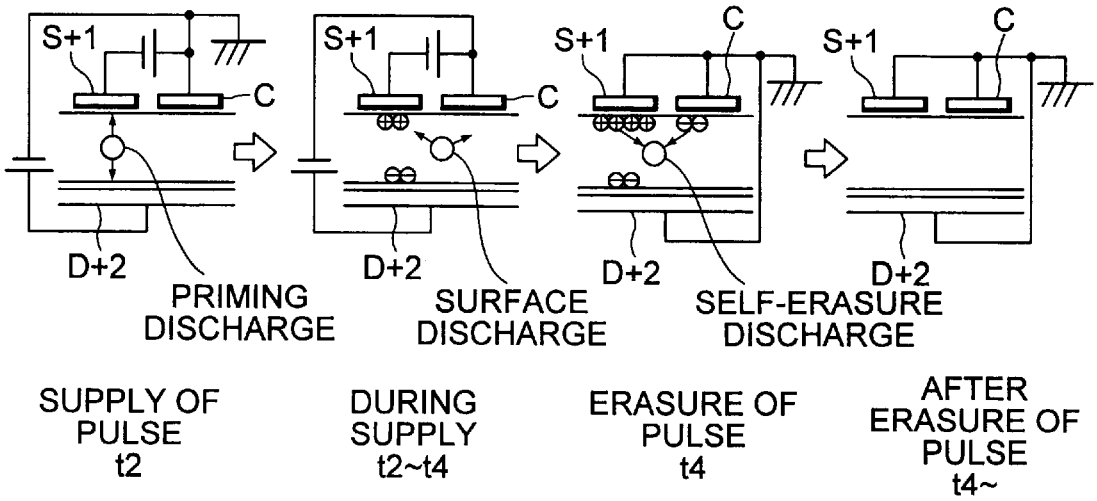
FIG. 15 shows transitional states of still another cell illustrated in FIG. 12.

Referring to FIGS. 13 to 15, description will be directed to the states of each cell which emerge during the scan priming period T1-1. In FIG. 13, consideration is made about the cell which is specified by (1,1) in FIG. 5 and which is located at the cross point between the scanning electrode S+1 and the data electrode D+1. As shown in FIG. 11, the scanning electrode S+1 is given the negative scan priming pulse Psp during the time slot from t2 to t4 while the data electrode D+1 is given the positive priming data pulse Ppd during the time slot from t4 to t6.

Taking the above into account, the states of the cell (1, 1) will be successively mentioned with reference to FIG. 13. At the time instant t2, the scanning electrode S+1 is given the negative scan priming pulse Psp with the sustain electrode C grounded, as illustrated in the leftmost side of FIG. 13. The negative scan priming pulse Psp lasts for the time slot from t2 to t4 with the sustain electrode C kept at a positive voltage, as shown in the leftmost side but one. Thereafter, the scan electrode S+1, the sustain electrode C, and the data electrode D+1 are grounded for the time slot from t2 to t4 and for the following time slot, as illustrated on the two right-hand side drawings. In other words, no pulse is impressed onto the cell. As readily understood from FIG. 13, no discharge takes place in the cell when the scan priming pulse Psp alone is given to the cell.

In FIG. 14, illustration is made about the cell which is located at the cross point between the scanning electrode S+2 and the data electrode D+2 both of which are shown in FIGS. 11 and 12. As illustrated in the leftmost drawing, the priming data pulse Ppd starts to be supplied to the data electrode D+2 at the time instant t2, with the scanning electrode S+2 and the sustain electrode C grounded, and lasts for the time slot from t2 to t4, as shown in FIG. 14. In any event, no negative scan priming pulse Psp is given to the scanning electrode S+2 and the sustain electrode C.

In any event, no priming discharge is caused to occur in the cells illustrated in FIGS. 13 and 14 because the voltage of the priming data pulse Ppd or the scan priming pulse Psp is lower than a discharge starting voltage.

In FIG. 15, illustration is made about the states of the cell which is located at the cross point between the scanning electrode S+1 and the data electrode D+2. At the time instant t2, the scanning electrode S+1 is supplied with the negative scan priming pulse Psp and the data electrode D+2 is supplied with the positive priming data pulse Ppd, as shown in the leftmost side of FIG. 15. In this case, the priming or opposing discharge is caused to occur between the scanning and the data electrodes S+1 and D+2. In this event, a surface-discharge is also induced between the scanning electrode S+1 and the sustain electrode C, as illustrated in FIG. 15. As a result, the priming discharge is expanded towards the sustain electrode C.

Thereafter, when supply of the pulses Psp and Ppd is stopped, wall charges are left due to the priming discharge on the scanning electrode S+1, the sustain electrode C, and the data electrode D+2, as shown in the third drawing of FIG. 15. The wall charges between the scanning electrode S+1 and the sustain electrode C brings about or induces a self-erasure discharge. Such a discharge also lightens a phosphorous material.

Subsequently, the wall charges are reset or erased by supplying the reset pulse Pres during the reset period T1-2, as shown in FIG. 10. The first time interval T1 is followed by the scanning period T2-1 of the second time interval T2 for displaying the tones of the image.

Figure 16:
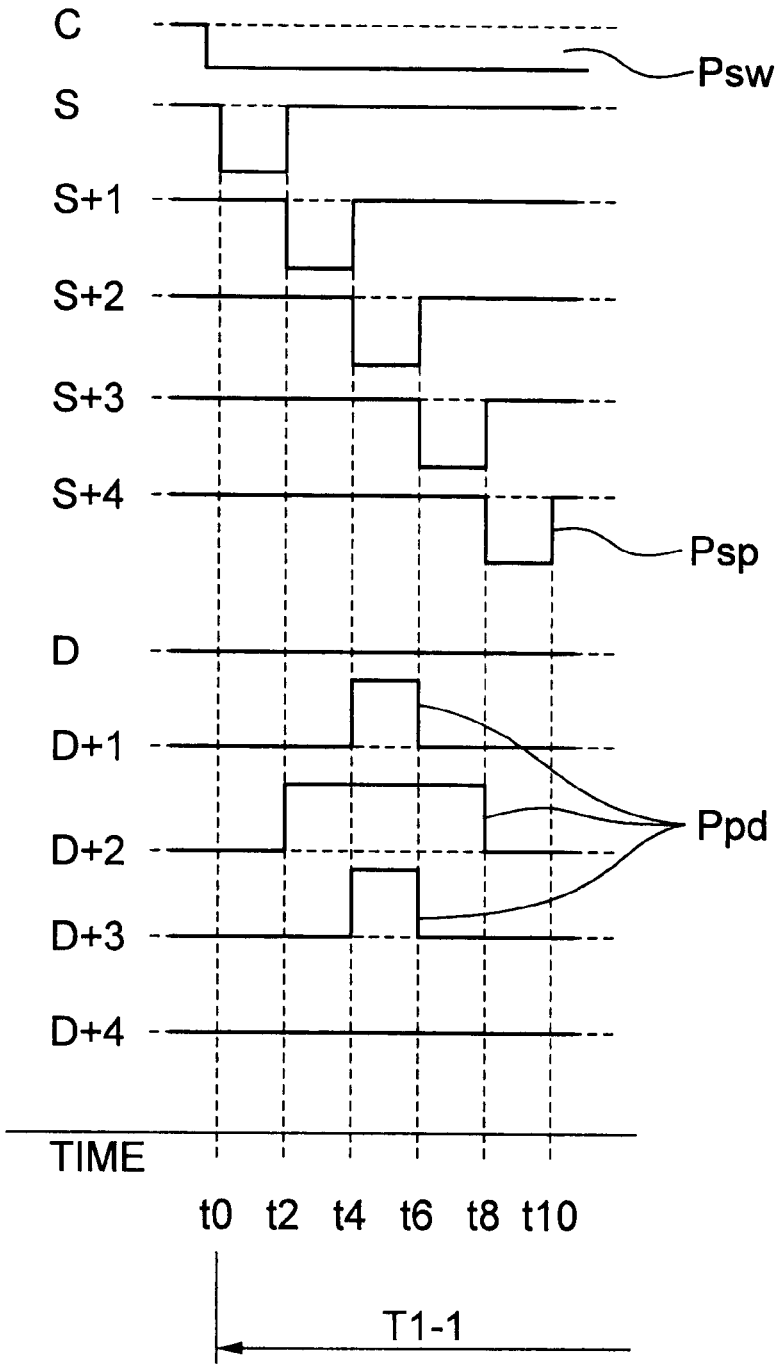
FIG. 16 shows a time chart for use in describing a driving method according to a second embodiment of this invention.
Figure 17:
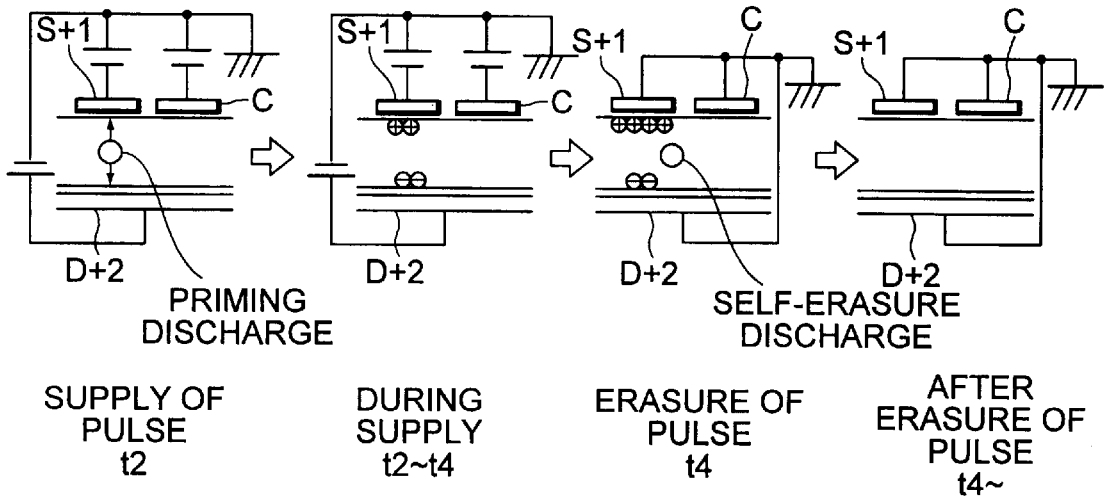
FIG. 17 shows transitional states of a cell which is illustrated in FIG. 12 and which is driven by the driving method illustrated in FIG. 16.

Referring to FIGS. 16 and 17, description will be made about a driving method according to a second embodiment of this invention. The driving method is assumed to be used for driving an A. C. type PDP. As shown in FIG. 16, the driving method is specified by driving waveforms in the scan priming period T1-1 of the first time interval T1, as shown in FIG. 9. The driving method illustrated in FIG. 16 is similar to that illustrated in FIG. 11 except that a negative sub-priming pulse Psw is given within the scan priming period T1-1 to the sustain electrodes C, as illustrated along the top line of FIG. 16.

When the negative sub-priming pulse Psw is given to the sustain electrodes C within the priming time interval T1, a potential difference between surface electrodes can be decreased. This shows that it is possible to avoid wrong discharges which might occur due to the potential difference between the scanning electrodes Sk and the sustain electrodes C even when the scan priming pulse voltage is increased for the priming time interval. As a result, the priming discharges can be stabilized with this method. In addition, reducing the potential difference between the surface electrodes is very helpful to prevent the priming discharges from being expanded along the surface electrodes. Therefore, the priming discharges can be favorably restricted between opposing electrodes, namely, the scanning and the data electrodes Sk and Dk, which brings about a reduction of a luminance in the priming discharges. Thus, it is possible to improve a tone characteristic in a dark image and a quality of an image.

In FIG. 17, the states of each cell are shown when the cell is driven by the driving method mentioned above. Herein, consideration is made about the cell located at the cross point between the scanning electrode S+1 and the data electrode D+2 both of which are illustrated in FIGS. 11 and 12.

In the example illustrated in FIG. 17, the states of the above-mentioned cell are successively changed from the leftmost side to the rightmost one of FIG. 17 during the time slots from t2 to t4.

At the time instant t2, the scanning electrode S+1 is given the negative scan priming pulse Psp and the sustain electrodes C are given the negative sub-priming pulse Psw while the data electrode D+2 is also given the positive priming data pulse Ppd. In this state, the opposing discharge alone takes place between the scanning electrode S+1 and the data electrode D+2.

It is to be noted that no surface discharge is caused to occur between the scanning electrode S+1 and the adjacent sustain electrode C, as shown in FIG. 17. This is because the negative sub-priming pulse Psw is given to-the adjacent sustain electrode C and, as a result, the potential difference is reduced between the scanning electrode S+1 and the adjacent electrode C. During the time slot between the time instants t2 and t4, the opposing discharge is maintained between the scanning electrode S+1 and the data electrode D+2. As shown in FIG. 17, charged particles are accumulated on the scanning and the data electrodes S+1 and D+2 while the negative scan priming pulse Psp and the positive priming data pulse Ppd are supplied to the scanning electrode S+1 and the data electrode D+2, respectively.

Thereafter, when the negative scan priming pulse Psp, the positive priming data pulse Ppd, and the negative sub-priming pulse Psw are turned off, self-erasure discharge is started at the time instant t4 and is thereafter stopped as shown in the rightmost drawing.

Figure 18:
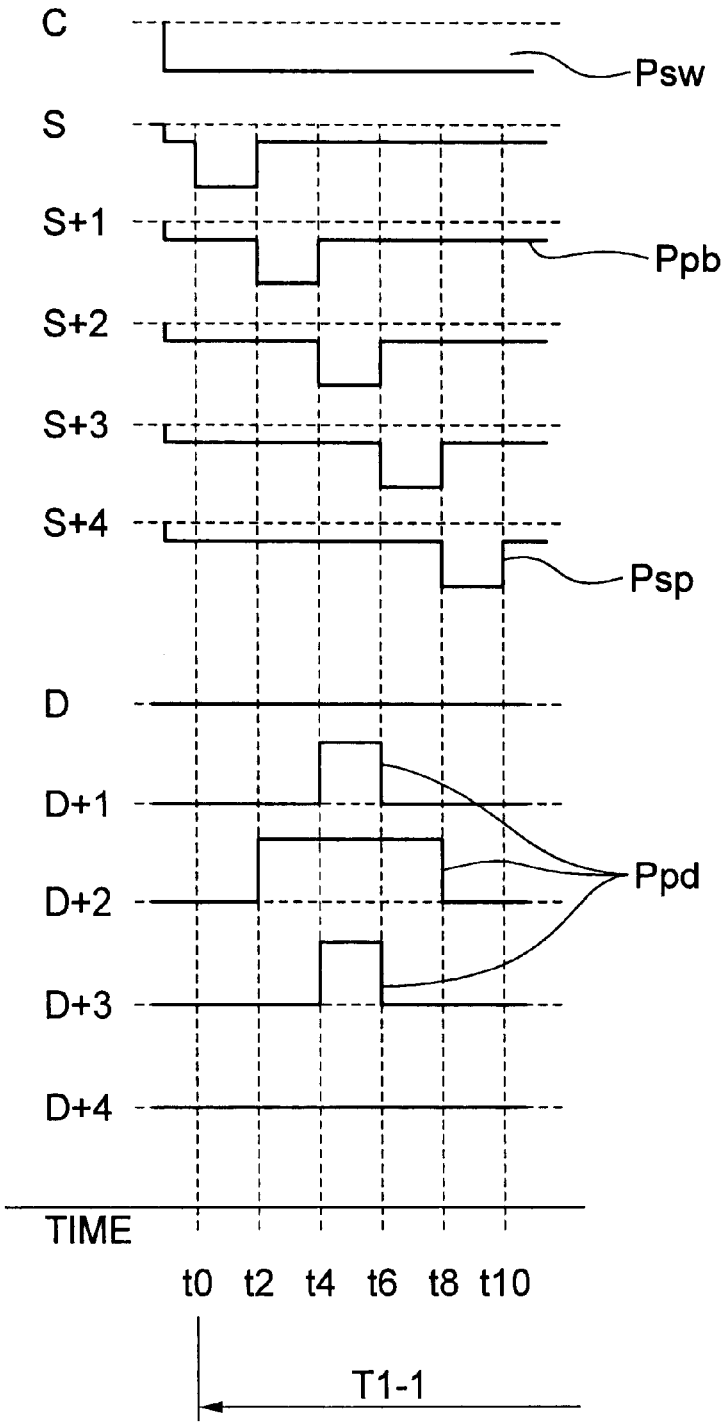
FIG. 18 shows a time chart for use in describing a driving method according to a third embodiment of this invention.
Figure 19:
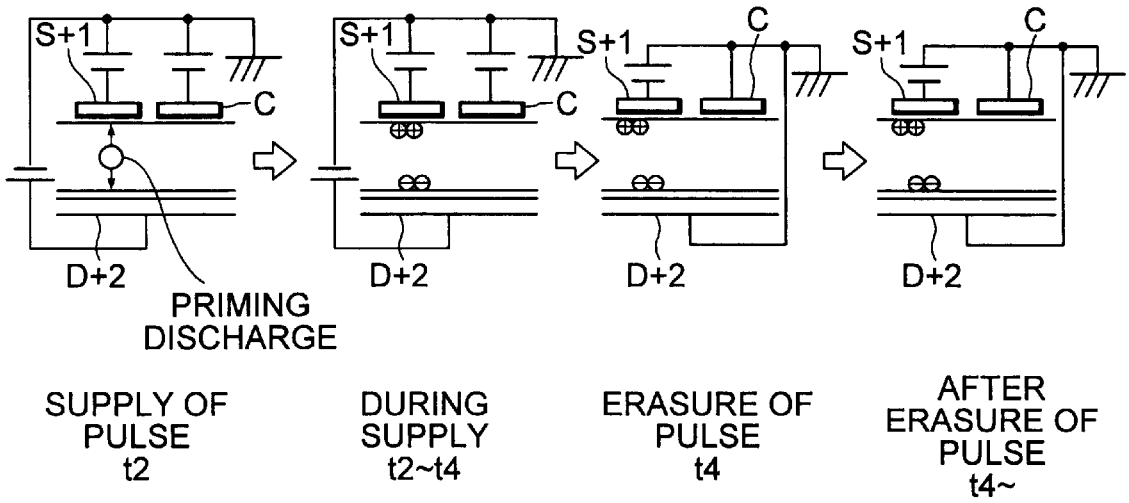
FIG. 19 shows transitional states of a cell which is shown in FIG. 12 and which is driven by the driving method according to the third embodiment of this invention.

Referring to FIGS. 18 and 19, description will be made about a driving method according to a third embodiment of this invention. It is assumed that the driving method is used for driving the A. C. type PDP, like the other embodiments. As shown in FIG. 18, the driving method is also specified by operation which is carried out in the scan priming period T1-1 of the first time interval T1, namely, the sub-field SF0. The driving method according to the third embodiment is similar to that illustrated in FIGS. 16 and 17 except that all of the scanning electrodes Sk are given negative priming base pulses Ppb during the scan priming period T1-1, as shown in FIG. 18. Each of the negative priming base pulses Ppb has an amplitude of, for example, −80 to −100 volts and is synchronized with the the negative sub-priming pulse Psw.

When each of the scan priming pulses Psp exceeds an amplitude of 150 volts, self-erasure discharges may be caused to occur due to wall charges which emerge from undesired discharges when each scan priming pulse Psp is turned off. Such undesired discharges unsatisfactorily lighten each cell many times and degrade the tone characteristic for displaying the dark image. In other words, supplying the priming base pulses Ppb to the scanning electrodes is effective to suppress occurrence of such undesired discharges.

In FIG. 19, the transitional states are illustrated in a manner similar to FIG. 17, as an example of the cell which is located at the cross point between the scanning electrode S+1 and the data electrode D+2 shown in FIG. 12. At the time instant t2, the priming base pulse Ppb, the scan priming pulse Psp, and the priming data pulse Ppd are given to the corresponding electrodes, as shown in FIG. 19. The resultant opposing discharge is caused to occur between the scanning electrode S+1 and the data electrode D+2 and lasts for the time slots between t2 and t4 with charged particles accumulated on the scanning electrode S+1 and the data electrode D+2. When the priming base pulse Ppb, the scan priming pulse Psp, and the priming data pulse Ppd are turned off at the time instant t4, the charged particles are left on the scanning electrode S+1 and the data electrode D+2 without any surface discharge between the scanning electrode S+1 and the adjacent sustain electrode C, as illustrated in the rightmost side drawing of FIG. 19. Thus, decreasing the potential difference between the scanning electrode S+1 can preferably reduce the probability of occurrence of the surface discharges and the adjacent sustain electrode C.

Figure 20:
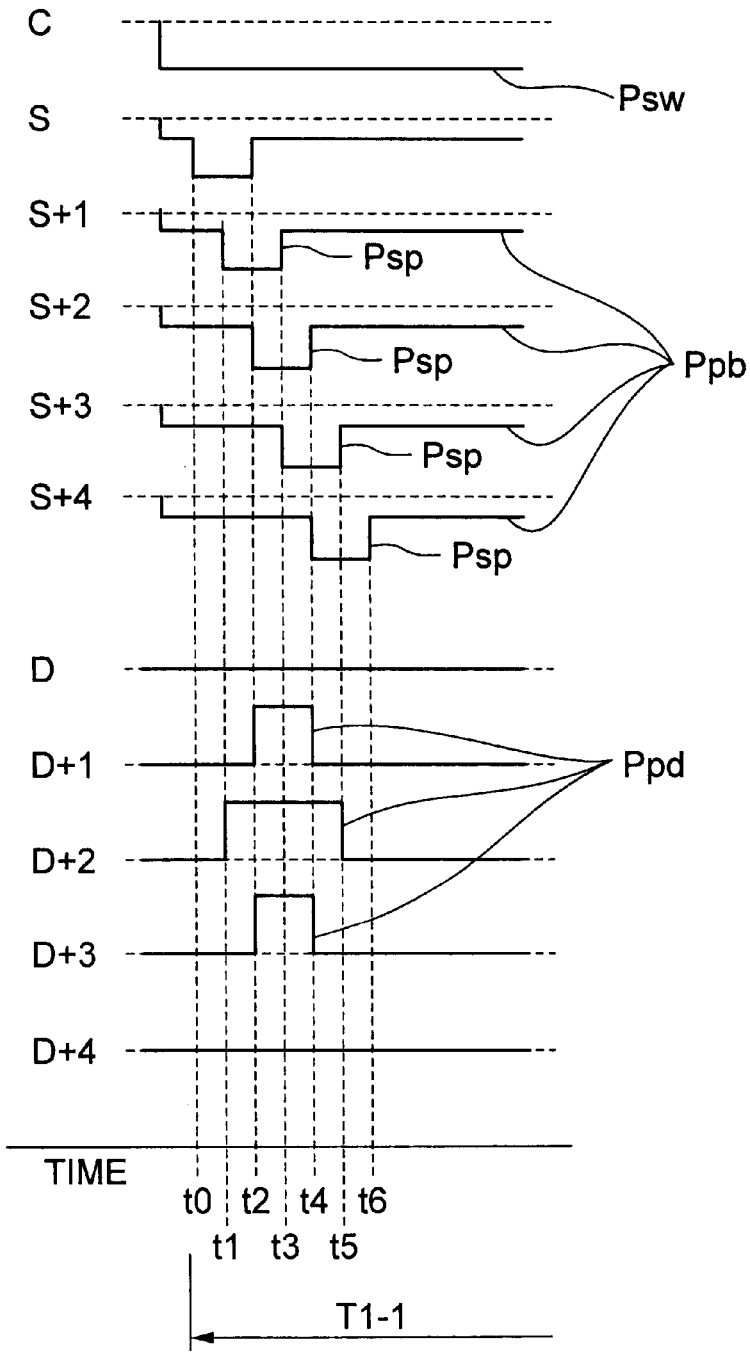
FIG. 20 shows a time chart for use in describing a driving method according to a fourth embodiment of this invention.
Figure 21:
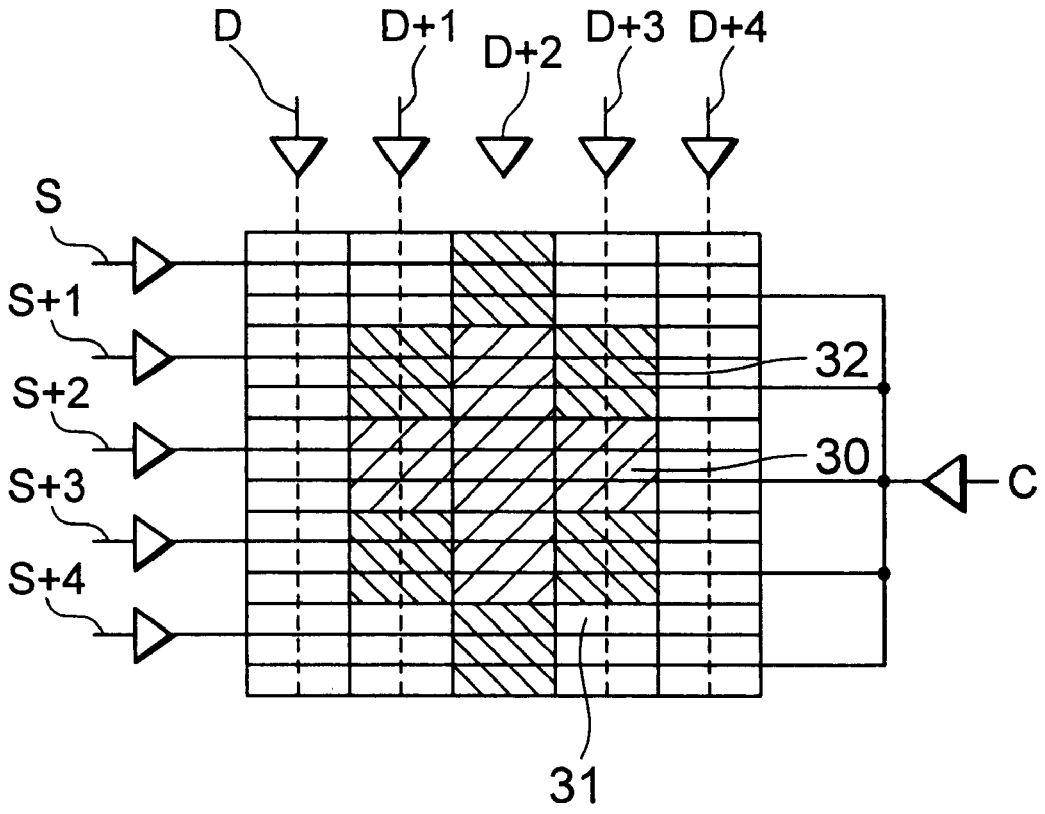
FIG. 21 shows a diagrammatic view for use in describing the PDP driven by the driving method illustrated in FIG. 20.

Referring to FIGS. 20 and 21, a driving method according to a fourth embodiment of this invention is similar to that illustrated in FIGS. 18 and 19 except that the scan priming pulses Psp partially overlap with one another.

The illustrated driving method is also specified by the scan priming period T1-1 of the first time interval T1. Like in FIGS. 18 and 19, the priming base pulse Ppb is superposed on the scan priming pulse Psp. It is to be noted that the scan priming pulses Psp given to adjacent ones of the scanning electrodes, such as S and S+1; S+1 and S+2; S+2 and S+3, overlap with one another during a predetermined time t, as shown in FIG. 20. Such overlap of the adjacent scan priming pulses Psp can shorten a total time for the priming time interval. The priming data pulses Ppd are produced in synchronism with the scan priming pulses Psp, as shown in FIG. 20.

Since the scan priming pulses overlap with one another, two or more scanning electrodes are supplied with the same voltage during an overlap time of the scan priming pulses. This implies that priming discharges are caused to occur in two or more cells adjacent to one another.

In FIG. 21, object cells depicted by 30 are lightened together with adjacent cells collectively depicted by 32. This means that priming discharges take place in both the object cells and the adjacent cells. In this event, the adjacent cells 32 are kept inactive during the remaining time intervals.

From this fact, it is readily understood that the priming discharges are caused to occur in a widened region of the PDP because a priming region is expanded by an area determined by the overlapped scan priming pulses Psp. Therefore, charged particles are generated on the widened region, which results in improvement of a write-in characteristic at an image edge zone.

While this invention has thus far been described in conjunction with several embodiments thereof, it will readily be possible for those skilled in the art to put this invention into practice in various other manners. For example, the pulse width of each scan priming pulse may not be restricted to twice the pulse width of the scan pulse used in the tone displaying sub-fields. In addition, the overlap time illustrated in FIGS. 20 and 21 may be changed from t to any other time. Furthermore, this invention is applicable to a D.C. type PDP.

In any event, the priming discharges are caused to occur in a locally limited region of the PDP which includes a display region to be displayed in each field and a peripheral region adjacent to the display region. Inasmuch as the remaining region except the locally limited region is kept at a luminance which is substantially equal to 0, the contrast of the dark image becomes substantially infinite. In addition, the undesired discharges can be suppressed in the embodiment which uses the sub-priming pulses. The self-erasure discharges can also be suppressed in the embodiment which uses the priming base pulses. Anyway, the contrast can be improved at the priming region at which the priming discharges are caused to occur. In the above-mentioned embodiments, the discharges are securely made in the cells within each scan priming pulse because the pulse width of the scan priming pulse is expanded as compared with the conventional method. This enables stable supply of the charged particles in the write-in operation which is carried out after the priming discharges and, therefore, can improve the write-in characteristic.

What is claimed is:

1. A method of driving a plasma display panel (PDP) to display an image at every field which is divisible into n sub-fields, where n is a positive integer greater than unity, the PDP comprising a plurality of scanning electrodes, a plurality of data electrodes, and a plurality of cells located at cross points between the scanning electrodes and the data electrodes, the method comprising:

determining one sub-field as a priming sub-field and the remaining sub-fields as display sub-fields, respectively;

causing priming discharges to occur only at selected ones of the cells only within the priming sub-field with no priming discharges caused to occur at the remaining cells except the selected ones of the cells; and causing display discharges to occur at the selected cells within the display sub-fields to display the image.

2. A method as claimed in claim 1, wherein the step of causing the priming discharges to occur comprises the steps of:

selecting, as selected scanning electrodes and selected data electrodes, the scanning electrodes and the data electrodes, respectively, which correspond to the selected cells; and driving the selected scanning electrodes and the selected data electrodes in the first sub-field by scan priming pulses and priming data pulses, respectively.

3. A method as claimed in claim 2, wherein the first sub-field includes a scanning period for scanning the scanning electrodes.

4. A method as claimed in claim 3, wherein the step of driving the selected scanning electrodes and the selected data electrodes comprises the steps of:

successively generating the scan priming pulses; and successively generating the priming data pulses in synchronism with the scan priming pulses.

5. A method as claimed in claim 1, wherein the step of causing display discharges to occur at the selected cells within the second through the n-th sub-fields comprises the step of:

supplying, in the second through the n-th sub-fields, the selected scanning electrodes and the selected data electrodes with normal scan pulses and normal data pulses which are different from the scan priming pulses and the priming data pulses, respectively.

6. A method as claimed in claim 5, wherein each of the scan priming pulses and the priming data pulses is different in pulse width from each of the normal scan pulses and the normal data pulses.

7. A method as claimed in claim 6, wherein the pulse width of each of the scan priming pulses and the priming data pulses is equal to twice the pulse width of each of the normal scan pulses and the normal data pulses.

8. A method as claimed in claim 5, the PDP further comprising a plurality of additional-electrodes arranged in parallel with the scanning electrodes, wherein each of the second through the n-th sub-fields is divided into a scanning period for the display discharges, a sustain period for sustaining the display-discharges, and a reset period for erasing charged particles emerging from the display discharges.

9. A method of driving a plasma display panel (PDP) to display an image at every field which is divisible into n sub-fields, where n is a positive integer greater than unity, the PDP comprising a plurality of scanning electrodes, a plurality of data electrodes, and a plurality of cells located at cross points between the scanning electrodes and the data electrodes, the method comprising:

determining one sub-field as a priming sub-field and the remaining sub-fields as display sub-fields, respectively;

causing priming discharges to occur only at selected ones of the cells only within the priming sub-field with no priming discharges caused to occur at the remaining cells except the selected ones of the cells; and causing display discharges to occur at the selected cells within the display sub-fields to display the image, wherein the step of causing the priming discharges to occur comprises the steps of:

selecting, as selected scanning electrodes and selected data electrodes, the scanning electrodes and the data electrodes, respectively, which correspond to the selected cells; and driving the selected scanning electrodes and the selected data electrodes in the first sub-field by scan priming pulses and priming data pulses, respectively; and wherein the PDP further comprises a plurality of additional electrodes arranged in parallel with the scanning electrodes, wherein the first sub-field includes a scanning period for scanning the scanning electrodes to cause the priming discharges to occur in the selected cells and a reset period for resetting charged particles emerging from the priming discharges.

10. A method as claimed in claim 9, further comprises the step of:

supplying reset pulses in the reset period of the first sub-field to erase the priming discharges.

11. A method of driving a plasma display panel (PDP) to display an image at every field which is divisible into n sub-fields, where n is a positive integer greater than unity, the PDP comprising a plurality of first electrodes, a plurality of second electrodes intersecting the first electrodes, a plurality of third electrodes parallel with the first electrodes, and a plurality of cells located at cross points between the first electrodes and the second electrodes, the method comprising:

determining one sub-field as a priming sub-field and the remaining sub-fields as display sub-fields, respectively;

supplying the third electrodes with sub-priming pulses in the priming sub-field;

supplying the first and the second electrodes with first and second priming pulses, respectively, with the sub-priming pulses in the priming sub-field to cause priming discharges to occur only at selected ones of the cells only within the priming sub-field and to cause no priming discharges to occur at the remaining cells except the selected ones of the cells; and causing display discharges to occur at the selected cells within the display sub-fields to display the image.

12. A method as claimed in claim 11, wherein the first, the second, and the third electrodes are scanning electrodes, data electrodes, and sustain electrodes, respectively, while the first and the second priming pulses are scan priming pulses and priming data pulses, respectively.

13. A method as claimed in claim 11, wherein each of the first priming pulses have a polarity inverse to each of the second priming pulses.

14. A method as claimed in claim 13, wherein the sub-priming pulses have the same polarity as the first priming pulses.

15. A method of driving a plasma display panel (PDP) to display an image at every field which is divisible into n sub-fields, where n is a positive integer greater than unity, the PDP comprising a plurality of first electrodes, a plurality of second electrodes intersecting the first electrodes, a plurality of third electrodes parallel with the first electrodes, and a plurality of cells located at cross points between the first electrodes and the second electrodes, the method comprising:

determining one sub-field as a priming sub-field and the remaining sub-fields as display sub-fields, respectively;

supplying the third electrodes with sub-priming pulses in the priming sub-field;

supplying the first and the second electrodes with first and second priming pulses, respectively, with the sub-priming pulses in the priming sub-field to cause priming discharges to occur only at selected ones of the cells only within the priming sub-field and to cause no priming discharges to occur at the remaining cells except the selected ones of the cells; and causing display discharges to occur at the selected cells within the display sub-fields to display the image, wherein the first, the second, and the third electrodes are scanning electrodes, data electrodes, and sustain electrodes, respectively, while the first and the second priming pulses are scan priming pulses and priming data pulses, respectively; and, wherein the step of causing the display discharges to occur within the second through the n-th sub-fields comprises the steps of:

generating first and second normal pulses different from the first and the second priming pulses;

supplying the scan electrodes and the data electrodes with the first and the second normal pulses to cause the display discharges to occur in the selected cells;

supplying the sustain electrodes with sustain pulses to sustain the display discharges in the selected cells; and stopping the display discharges by supplying reset pulses to the sustain electrodes.

16. A method as claimed in claim 15, wherein the first and the second priming pulses have pulse widths wider than the first and the second normal pulses.

17. A method as claimed in claim 16, wherein each pulse width of the first and the second priming pulses is equal to twice each pulse width of the first and the second normal pulses.

18. A method of driving a plasma display panel (PDP) to display an image at every field which is divisible into n sub-fields, where n is a positive integer greater than unity, the PDP comprising a plurality of first electrodes, a plurality of second electrodes intersecting the first electrodes, a plurality of third electrodes parallel with the first electrodes, and a plurality of cells located at cross points between the first electrodes and the second electrodes, the method comprising:

determining one sub-field as a priming sub-field and the remaining sub-fields as display sub-fields, respectively;

successively supplying the first electrodes with first priming pulses partially overlapping with one another in the priming sub-field;

successively supplying the second electrodes with second priming pulses synchronized with the first priming pulses in the priming sub-field to cause priming discharges to occur only within the priming sub-field only in selected ones of the cells determined by the first and the second electrodes and peripheral ones of the cells adjacent to the selected cells and to cause no priming discharges to occur in the remaining cells except the selected cells and the peripheral cells; and causing display discharges to occur at the selected cells within the display sub-fields to display the image.

19. A method as claimed in claim 18, further comprising the steps of:

supplying the third electrodes with sub-priming pulses in the first sub-field, with the first and the second electrodes given the first and the second priming pulses, respectively.

20. A method of driving a plasma display panel (PDP) to display an image at every field which is divisible into n sub-fields, where n is a positive integer greater than unity, the PDP comprising a plurality of scanning electrodes, a plurality of data electrodes, and a plurality of cells located at cross points between the scanning electrodes and the data electrodes, the method comprising:

determining a plurality of said sub-fields as priming sub-fields and the remaining sub-fields as display sub-fields, respectively, wherein said plurality is less than n;

causing priming discharges to occur only at selected ones of the cells only within the priming sub-fields with no priming discharges caused to occur at the remaining cells except the selected cells; and causing display discharges to occur at the selected cells within the display sub-fields to display the image.

21. A method of driving a plasma display panel (PDP) comprising: receiving image information; and causing no priming discharge to occur at unlightened ones of cells for dark display in response to the image information, wherein the priming discharge is caused to occur between scanning and data electrodes opposite to each other, and.

22. A method as claimed in claim 21, the PDP further comprising sustain electrodes extended in parallel with the scanning electrodes, comprising:

supplying the sustain electrodes corresponding to the cells put into the priming discharge with a voltage pulse that has the same polarity as the scan priming pulses and that is not higher than a discharge start voltage between the sustain and the data electrodes.

23. A method as claimed in claim 21, wherein the scanning electrodes are given during the priming discharge a voltage that has the same polarity as the scan priming pulses and an absolute value smaller than the latter and that is not higher than a discharge start voltage between the scanning and the data electrodes.

24. A method as claimed in claim 21, wherein the scan priming pulses have widths wider than display scanning pulses.

25. A method as claimed in claim 21, wherein the scan priming pulses given to the scanning electrodes adjacent to each other have an overlap time.

26. A method of driving a plasma display panel (PDP) comprising:

causing priming discharge to occur at lightened ones of cells for enlightened display in response to the image information; and causing no priming discharge to occur at unlightened ones of the cells for dark display.

27. A method as claimed in claim 26, wherein the priming discharge is caused to occur between scanning and data electrodes opposite to each other.

28. A method as claimed in claim 27, wherein the priming discharge is caused to occur by successively giving scan priming pulses to the scanning electrodes corresponding to the lightened cells and by successively giving priming data pulses to the data electrodes corresponding to the lightened cells, in synchronism with the scan priming pulses.

29. A method as claimed in claim 28, the PDP further comprising sustain electrodes extended in parallel with the scanning electrodes, comprising:

supplying the sustain electrodes corresponding to the cells put into the priming discharge with a voltage pulse that has the same polarity as the scan priming pulses and that is not higher than a discharge start voltage between the sustain and the data electrodes.

30. A method as claimed in claim 28, wherein the scanning electrodes are given during the priming discharge a voltage that has the same polarity as the scan priming pulses and an absolute value smaller than the latter and that is not higher than a discharge start voltage between the scanning and the data electrodes.

31. A method as claimed in claim 28, wherein the scan priming pulses have widths wider than display scanning pulses.

32. A method as claimed in claim 28, wherein the scan priming pulses given to the scanning electrodes adjacent to each other have an overlap time.

* * * * *